US010731426B2

(12) United States Patent
Brandsvoll et al.

(10) Patent No.: US 10,731,426 B2
(45) Date of Patent: Aug. 4, 2020

(54) DRILLING SYSTEM AND METHOD

(71) Applicant: MHWIRTH AS, Kristiansand S (NO)

(72) Inventors: Thor Arne S. Brandsvoll, Kristiansand (NO); Soeren Oeydna, Kristiansand (NO)

(73) Assignee: MHWIRTH AS, Kristiansand S (NO)

( * ) Notice: Subject to any disclaimer, the term of this patent is extended or adjusted under 35 U.S.C. 154(b) by 163 days.

(21) Appl. No.: 16/006,863

(22) Filed: Jun. 13, 2018

(65) Prior Publication Data

US 2018/0363392 A1 Dec. 20, 2018

(30) Foreign Application Priority Data

Jun. 15, 2017 (NO) ..... 20170976

(51) Int. Cl.

| | |
|---|---|
| ***E21B 19/00*** | (2006.01) |
| ***E21B 19/08*** | (2006.01) |
| ***E21B 47/00*** | (2012.01) |
| ***E21B 19/10*** | (2006.01) |

(52) U.S. Cl.

CPC ..... *E21B 19/08* (2013.01); *E21B 19/00* (2013.01); *E21B 19/008* (2013.01); *E21B 19/10* (2013.01); *E21B 47/00* (2013.01)

(58) Field of Classification Search

CPC ..... E21B 19/00; E21B 19/008; E21B 19/08; E21B 19/10; E21B 47/00

See application file for complete search history.

(56) References Cited

U.S. PATENT DOCUMENTS

| | | | | |
|---|---|---|---|---|
| 3,866,468 | A | 2/1975 | Smith et al. | |
| 3,942,594 | A * | 3/1976 | Smith | E21B 21/08 175/27 |
| 4,748,563 | A | 5/1988 | Anthoine | |
| 6,032,929 | A | 3/2000 | Vatne | |
| 8,949,416 | B1 * | 2/2015 | Barnes | G06F 15/17306 370/229 |
| 2005/0114001 | A1 * | 5/2005 | Newman | B66C 13/50 701/50 |
| 2014/0246203 | A1 | 9/2014 | Pøhner | |
| 2015/0167446 | A1 * | 6/2015 | Taskinen | E21B 47/00 166/382 |
| 2016/0137466 | A1 | 5/2016 | Eriksson et al. | |
| 2018/0238162 | A1 * | 8/2018 | Jeffryes | E21B 19/08 |

(Continued)

FOREIGN PATENT DOCUMENTS

| | | | | |
|---|---|---|---|---|
| NO | 20160497 | A1 * | 10/2017 | E21B 17/107 |
| WO | WO 97/23705 | A1 | 7/1997 | |

(Continued)

*Primary Examiner* — Daniel P Stephenson

(74) *Attorney, Agent, or Firm* — Norman B. Thot

(57) ABSTRACT

A method of operating a drilling system includes suspending a tubular drill string from a travelling assembly into an opening on a drill floor, operating a sensor to measure and to provide a first signal, providing a second signal, and comparing the first signal with the second signal. The travelling assembly is a part of a hoisting system. The first signal represents an acceleration or a velocity of the tubular drill string in a direction into or a direction out of the opening. The second signal represents an operational parameter of the hoisting system. The operational parameter is indicative of a vertical speed or of a vertical acceleration of the travelling assembly.

13 Claims, 3 Drawing Sheets

(56) References Cited

U.S. PATENT DOCUMENTS

| | | | | |
|---|---|---|---|---|
| 2018/0245445 | A1* | 8/2018 | Theis | E21B 44/00 |
| 2018/0363392 | A1* | 12/2018 | Brandsvoll | E21B 19/08 |
| 2019/0106980 | A1* | 4/2019 | Waag | E21B 31/00 |
| 2019/0302723 | A1* | 10/2019 | Rojas | E21B 41/0092 |

FOREIGN PATENT DOCUMENTS

| | | | | |
|---|---|---|---|---|
| WO | WO 2013/076207 | A2 | 5/2013 | |
| WO | WO-2013076207 | A2 * | 5/2013 | E21B 19/09 |
| WO | WO 2014/209131 | A1 | 12/2014 | |
| WO | WO-2014209131 | A1 * | 12/2014 | B66D 1/82 |
| WO | WO-2015073387 | A1 * | 5/2015 | E21B 44/06 |

* cited by examiner

DRILLING SYSTEM AND METHOD

CROSS REFERENCE TO PRIOR APPLICATIONS

Priority is claimed to Norwegian Patent Application No. 20170976, filed Jun. 15, 2017. The entire disclosure of said application is incorporated by reference herein.

FIELD

The present invention relates to a drilling system and to a method, including, but not limited, to a system and a method for safely and operationally reliably handling a tubular pipe extending into a wellbore.

BACKGROUND

During drilling operations, for example, drilling carried out for petroleum exploration and exploitation, it is common to handle various tubulars used or installed in a wellbore with the aid of a drilling plant. The drilling plant is commonly arranged at ground level directly above the well or, in the case of offshore wells, on a platform or a floating vessel, such as a semi-submersible rig or a drillship. Such tubulars may include drill pipe, well casing, or other types of tubular pipe used in operations relating to creating or preparing the borehole. The drilling plant commonly comprises a dedicated hoisting system for this purpose, usually having a travelling assembly which carries the tubular string and raises or lowers the string into or out of the well. Such hoisting systems may, for example, be winch-based systems (e.g., using so-called drawworks) with a multiple stringed block, such as is described in WO 2013/076207 A2 and in WO 2014/209131 A1. An alternative solution is a cylinder lifting rig, such as the RamRig™ technology supplied by the current applicant. An example of a possible arrangement is described in WO 97/23705 A1.

Safe and reliable operation is of utmost importance when handling such tubular pipe extending into the wellbore in drilling plants. Irregularities in the pipe handling may, for example, compromise health and safety on the drill floor. Significant extra costs may also be incurred, both due to direct damage and delays, in the case of damage to the pipe, associated equipment, and/or to the well.

SUMMARY

An aspect of the present invention is to provide an improved system and a method for the safe and reliable handling of pipes in wellbore operations. An aspect of the present invention is to provide such systems and methods which have advantages over known solutions and techniques.

In an embodiment, the present invention provides a method of operating a drilling system which includes suspending a tubular drill string from a travelling assembly into an opening on a drill floor, operating a sensor to measure and to provide a first signal, providing a second signal, and comparing the first signal with the second signal. The travelling assembly comprises a part of a hoisting system. The first signal represents an acceleration or a velocity of the tubular drill string in a direction into or a direction out of the opening. The second signal represents an operational parameter of the hoisting system. The operational parameter is indicative of a vertical speed or of a vertical acceleration of the travelling assembly.

BRIEF DESCRIPTION OF THE DRAWINGS

The present invention is described in greater detail below on the basis of embodiments and of the drawings in which.

DETAILED DESCRIPTION

In an embodiment, the present invention provides a method of operating a drilling system comprising the steps: suspending a tubular string from a travelling assembly into an opening on a drill floor, the travelling assembly being part of a hoisting system; operating a sensor to measure and provide a first signal, the first signal representative of an acceleration, a velocity or a position of the tubular string in a direction into or out of the opening; providing second signal, the second signal representative of an operational parameter of the hoisting system; and comparing the first signal and the second signal.

The drilling system can, for example, comprise an automatic controller.

Figure 1:
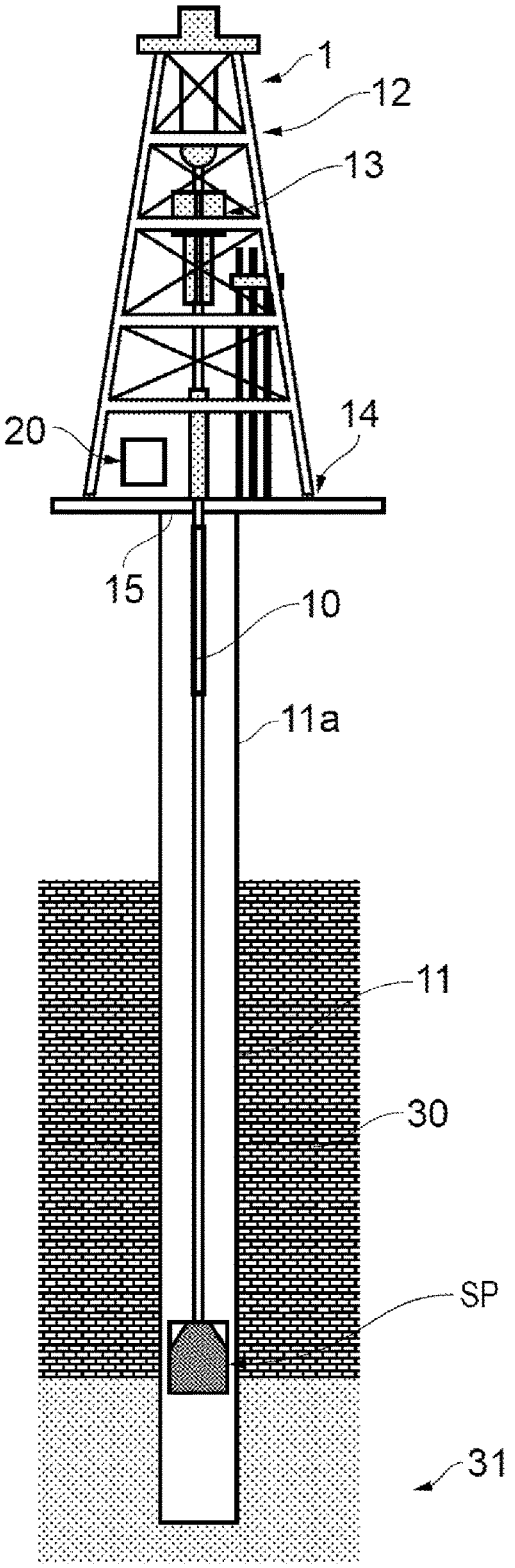
FIG. 1 illustrates a drilling plant.
Figure 2:
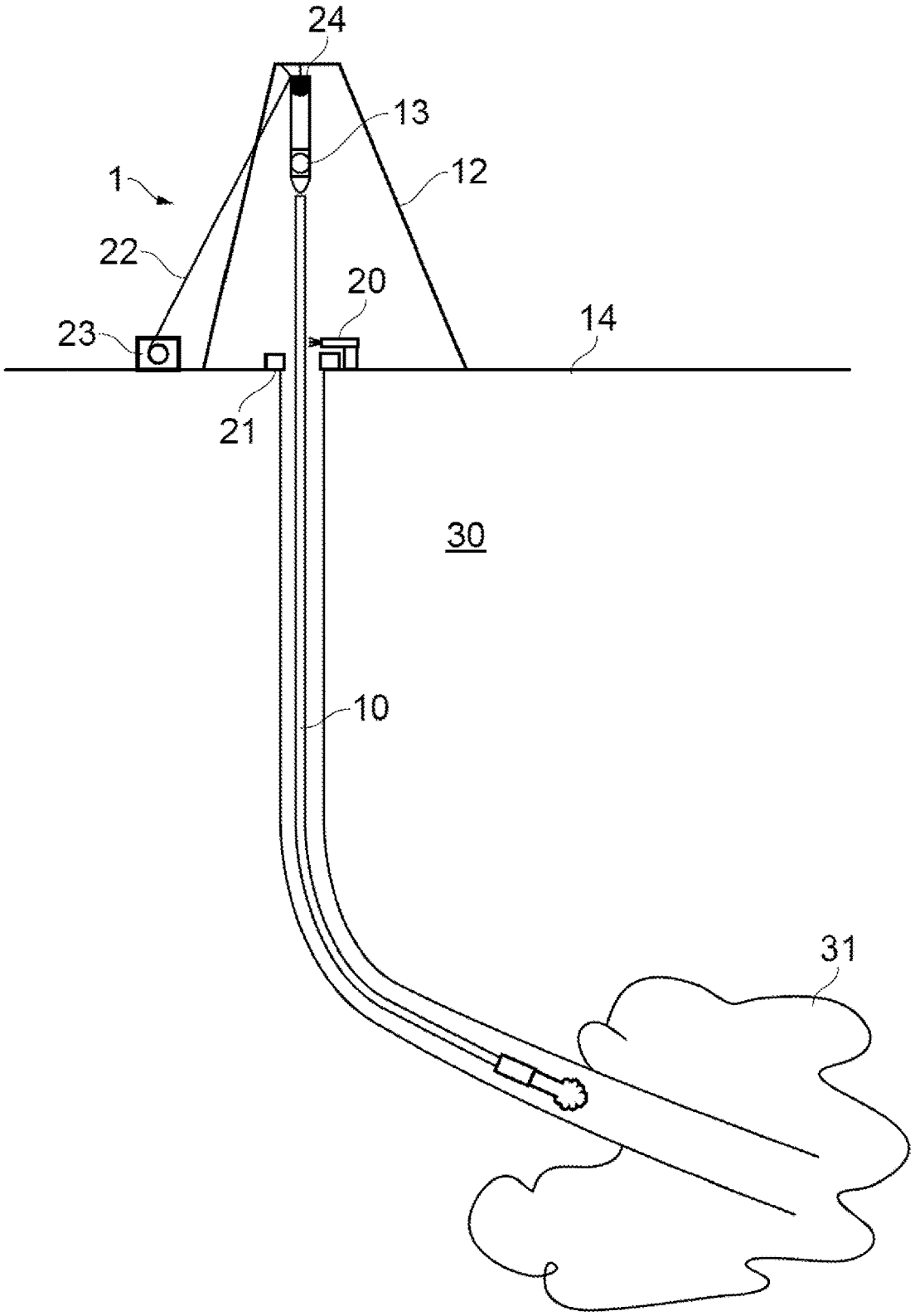
FIG. 2 illustrates a drilling plant.

A drilling plant according to an embodiment is illustrated schematically in FIGS. 1 and 2. The drilling plant comprises a derrick structure 12 arranged on a drill floor 14. A hoisting system 1 is provided in relation to the derrick structure 12. In the shown embodiment, the hoisting system 1 comprises a winch 23, a travelling assembly 13 and a crown block 24. A wire 22 extends from the winch 23, via multiple sheaves in the crown block 24 and a travelling block forming part of the traveling assembly 13 so as to suspend the travelling assembly 13 vertically above a well center opening 15 in the drill floor 14. In alternative embodiments, the hoisting system 1 may be based on a cylinder hoisting arrangement, as noted above.

A wellbore 11 extends through a subterranean formation 30 towards a petroleum reservoir 31. The wellbore 11 is connected to the well center opening 15 on the drill floor 14 via a riser 11*a* (as illustrated in FIG. 1) or directly (as shown in FIG. 2). A drill string 10 (or another elongate element) can thus be suspended from the travelling assembly 13 and extended downwards into the wellbore 11 to make a new hole or to carry out other operations downhole. The skilled person will recognize the above setup as a conventional drilling plant arrangement for offshore and land-based wells, respectively.

Occasionally, when moving the drill string 10 up and down in the wellbore 11, the drill string 10 can get stuck. This is indicated as "SP" in FIG. 1. This can partially or entirely prevent movement of the drill string 10. If the drill string 10 gets stuck when, for example, tripping into the well when the drill string 10 is hanging from the traveling assembly 13, the drill string 10 will start to move slower than the corresponding traveling assembly 13, whose speed is controlled by the hoisting system 1. If the traveling assembly 13 is not stopped in time, the tension in the drill sting 10 will be reduced and, in a worst case scenario, the weight of the traveling assembly 13 (which may include heavy equipment such as a drilling machine) will, partly or in full, act on the top of the drill string 10. Since the drill string 10 is generally designed to be in tension, and not designed to withstand large compression forces, this can cause damage to the drill string 10 at locations downhole or at the drill floor 14, and/or damage to other components.

The operation of the drilling system may comprise the steps: suspending the tubular drill string 10 from a travelling assembly 13 into the well center opening 15; operating a sensor 20 to provide a first signal representative of a vertical speed of the tubular string 10 into or out of the well center opening 15; providing a second signal representative of an operating speed of the hoisting system 1 and indicative of a vertical speed of the travelling assembly 13 produced by the hoisting system 1; and comparing the first signal and the second signal. Alternatively, instead of indicating the vertical speed of the travelling assembly 13, the second signal can be representative of an operational acceleration of the hoisting system 1, related to the vertical acceleration of the travelling assembly 13.

The sensor 20 can be provided on the drill floor 14 and may comprise, for example, an optical sensor which measures the speed of the drill string 10 moving into or out of the well center opening 15. Other types of sensors may alternatively, or in addition, be employed for this purpose, such as ultrasonic, radar, magnetic or machine vision sensor systems.

Figure 3:
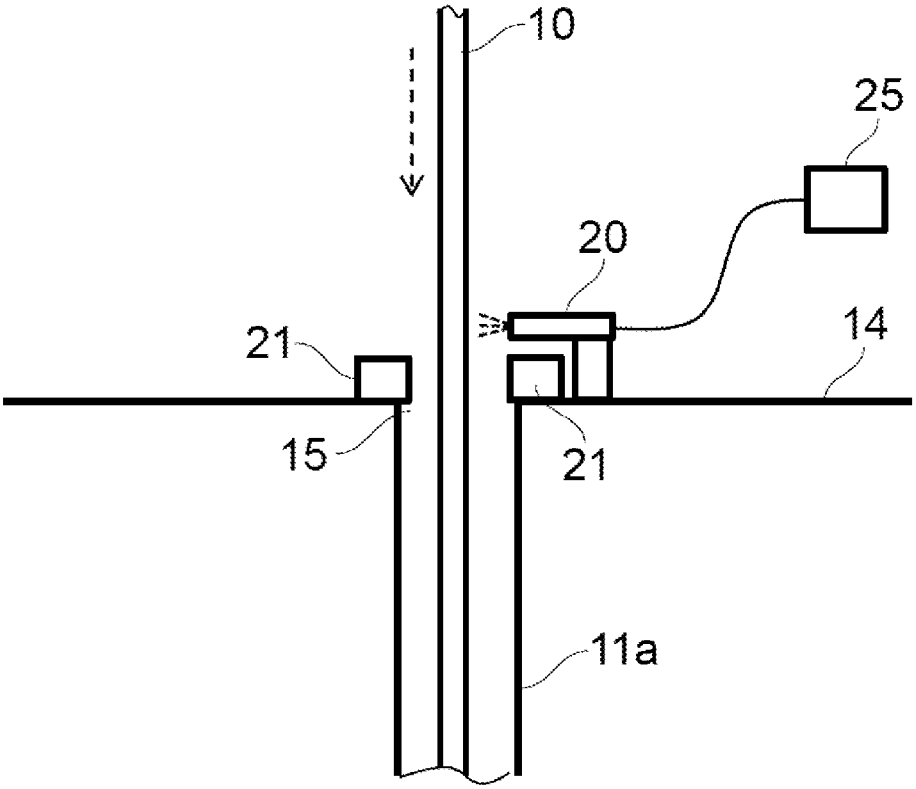
FIG. 3 illustrates parts of a drilling plant.

FIG. 3 schematically illustrates an embodiment where the sensor is connected to a controller 25. The controller 25 may form part of an overall drilling monitoring and management system and may, for example, include a display for displaying relevant information to the drilling operator.

The method may include providing a warning signal to the operator if an identified difference between the tubular drill string 10 speed and the traveling assembly 13 speed exceeds a threshold. The warning signal may, for example, be a visual signal or an audible signal. The threshold may, for example, be a pre-defined value selected by the operator and/or drilling plant designer which identifies a risk for excessive loads being applied on the top of the tubular drill string 10 due to a high speed of the traveling assembly 13 when compared to the speed of the drill string 10.

The second signal is representative of an operational parameter of the drilling plant and may, for example, represent a measured speed of the travelling assembly 13, the wire 22, or the winch 23. If using the measured speed of the wire 22 or winch 23, this speed will have a given linear correspondence to the speed of the travelling assembly 13. The travelling assembly speed can thereby be deduced from a given wire or winch speed. There will be a known relation, for example, between the rotational speed of the winch 23 and the vertical speed of the travelling assembly 13. By comparing the first and second signals, it is therefore possible to identify a discrepancy between the speed of the travelling assembly 13 produced by the hoisting system 1 and the actual speed of the drill string 10, a situation which may indicate that the drill string 10 is unintentionally slowing down. Such an undesired situation may be due to the drill string 10 being stuck in the wellbore 11 (or about to get stuck) when tripping in, in which case the drill string 10 speed will reduce compared to the travelling assembly 13 speed. By providing an early warning of this discrepancy, it may be possible to take corrective action before damage occurs, for example, before too much tension is taken off the drill string 10 or before weight from the travelling assembly 13 is imposed on the top end of the drill string 10. Such a situation may cause damage to both the drill string 10 (for example, buckling or breakage), the wellbore 11 and/or the riser 11*a*, the hoisting system 1, the travelling assembly 13 itself, or other drill floor equipment. As noted above, this situation may also have health and safety risks.

Such corrective action may include reducing the operating speed of the hoisting system 1 if the first signal indicates that a speed of the tubular drill string 10 into the well center opening 15 is lower than a speed of the traveling assembly 13 indicated by the second signal. Such corrective action may be taken automatically, for example, by an automatic controller.

Another example of an undesired situation is that the drill string 10 loosens from, i.e., disconnects, from the travelling assembly 13. In an embodiment, the method may include the steps of closing a set of slips 21 (see FIGS. 2 and 3) to prevent the drill string 10 from travelling into the well center opening 15 if the first signal indicates that a speed of the drill string 10 into the well center opening 15 is higher than a speed of the traveling assembly 13 indicated by the second signal.

An alternative to using a measured signal of a state of the hoisting system 1 may include using a second signal which is an operational input signal to the hoisting system 1. This may, for example, be a demand signal sent to the winch 23 (or to the hoisting cylinders in a cylinder-based hoisting system). This may provide an even faster response time for the system in that the speed of the drill string 10 is compared to the demanded output from the hoisting system 1. A risk of damage can be detected if, for example, the demanded lowering speed for the hoisting system 1 is higher than the actual string speed. One may therefore avoid, for example, a situation where an increased lowering speed is demanded from the hoisting system 1 at the same time the string speed reduces due to downhole forces acting on the drill string 10 to avoid "driving" the traveling assembly 13 into a stuck drill string 10.

Alternatively, the method may use position measurements or acceleration measurements of the drill string 10, measured by the sensor 20, as the first signal. The operational parameter of the hoisting system 1 may also be a position or acceleration reading. If, for example, using acceleration measurements, it can be detected if the string speed is retarding (for example due to sticking) when an actual measurement or a demand sent to the hoisting system 1 indicates an acceleration of the traveling assembly 13, a risk of damage can be detected. A combination of acceleration, speed and position measurements may also be used. The risk of excessive load on the drill string 10 can be identified, for example, if an acceleration value measured on the string 10 indicates retardation (e.g., due to sticking) while a speed measurement from the traveling assembly 13 is above a pre-determined threshold. In another example, if a downwards acceleration of the drill string 10 is measured to be higher than a threshold which the hoisting system 1 would be capable or configured to operate at, a "lost pipe" situation can then be identified and action taken, such as closing the slips 21.

Alternatively, the operational parameter of the hoisting system 1 may be a force acting on the hoisting system 1 from the drill string 10. This may be representative of the so-called "hook load" applied by the drill string 10 on the hoisting system components. This hook load will be seen by several components, such as the travelling assembly 13, the wire 22 and the winch 23, or by the hoisting cylinders in a cylinder-based hoisting system. By identifying an unexpected difference or change in the first signal, for example, the speed of the drill string 10, and the hook load, early identification of an irregular situation may be achieved. Yet another alternative may include the use of a power supplied to the hoisting system 1 as the operational parameter. This may be, for example, an electric, hydraulic or mechanical power supplied to a component of the hoisting system 1, such as an electric or hydraulic power supplied to the winch 23 or a hydraulic power supplied to a hoisting cylinder.

One or more of the method steps may be carried out automatically by the controller 25 (see FIG. 3). In particular, one or more of the steps of providing a warning signal to the operator, reducing the operating speed of the hoisting system 1, and closing a set of slips 21 to prevent the drill string 10 from travelling into the well center opening 15 may be carried out automatically.

According to embodiments described herein, a sensor system, for example, a visual sensor, can thereby be used to detect the position, velocity and/or acceleration of the drill string 10 relative to the rig and the drill floor 14. This information (one, two or all three) in combination with information about one or more operational parameters indicative of the state of the hoisting system 1, for example, the speed of, or power supplied to, the winch 23, can be used to detect a stuck pipe situation, a lost pipe situation, or another type of undesirable situation. This information can be used to change the speed of the winch 23 to avoid damage to, for example, the drill string 10, the riser 11*a*, or the wellbore 11.

According to the present invention, it is therefore possible to obtain earlier warning of such a situation, or the risk of such a situation occurring, which enables the possibility to take corrective action at an earlier time.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the present invention in diverse forms thereof.

The present invention is not limited to the embodiments described herein; reference should be had to the appended claims.

What is claimed is:

1. A method of operating a drilling system, the method comprising:

suspending a tubular drill string from a travelling assembly into an opening on a drill floor, the travelling assembly comprising a part of a hoisting system;

operating a sensor to measure and to provide a first signal, the first signal representing an acceleration or a velocity of the tubular drill string in a direction into or a direction out of the opening;

providing a second signal, the second signal representing an operational parameter of the hoisting system, the operational parameter being indicative of a vertical speed or of a vertical acceleration of the travelling assembly;

comparing the first signal with the second signal, and reducing an operating speed of the hoisting system if the discrepancy between the first signal and the second signal exceeds a first pre-defined threshold.

2. The method as recited in claim 1, wherein the operational parameter is at least one of, an acceleration or a speed of a hoisting system component which is directly or indirectly connected to the tubular drill string, an electric power, a hydraulic power or a mechanical power supplied to the hoisting system component, or a force acting on the hoisting system component from the tubular drill string.

3. The method as recited in claim 2, wherein the hoisting system component is the travelling assembly, a wire forming part of the hoisting system, a winch forming part of the hoisting system, or a hoisting cylinder forming part of the hoisting system.

4. The method as recited in claim 1, wherein the second signal is, an operational input signal to the hoisting system, or a measurement of the operational parameter taken at the hoisting system.

5. The method as recited in claim 1, further comprising:

operating an automatic controller to determine a third signal, the third signal being a function of the first signal and the second signal and being indicative of a discrepancy between the first signal and the second signal.

6. The method as recited in claim 5, further comprising:

outputting the third signal to an operator.

7. The method as recited in claim 5, further comprising:

providing a warning signal to an operator if the discrepancy exceeds a second pre-defined threshold.

8. The method as recited in claim 5, further comprising:

closing a set of slips to prevent the tubular drill string from travelling into the opening if the discrepancy exceeds a third pre-defined threshold.

9. The method as recited in claim 8, wherein the step of closing the set of slips is executed automatically by the automatic controller.

10. The method as recited in claim 1, wherein the step of reducing the operating speed of the hoisting system is executed automatically by the automatic controller on the hoisting system.

11. The method as recited in claim 1, wherein the sensor is an optical sensor, an ultrasonic sensor, a radar, a magnetic sensor or a machine vision sensor.

12. A drilling system comprising:

a hoisting system comprising a travelling assembly, the travelling assembly being configured to suspend a tubular drill string into an opening on a drill floor;

a sensor configured to measure and to provide a first signal; and an automatic controller which is configured to perform the method as recited in claim 1.

13. The drilling system as recited in claim 12, wherein the sensor is an optical sensor, an ultrasonic sensor, a radar, a magnetic sensor or a machine vision sensor.

* * * * *